US007469116B2

(12) United States Patent
Kitajima

(10) Patent No.: US 7,469,116 B2
(45) Date of Patent: Dec. 23, 2008

(54) IMAGE FORMING APPARATUS

(75) Inventor: Kenichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 240 days.

(21) Appl. No.: 11/563,347

(22) Filed: Nov. 27, 2006

(65) Prior Publication Data

US 2007/0122190 A1 May 31, 2007

(30) Foreign Application Priority Data

Nov. 30, 2005 (JP) ..... 2005-347218

(51) Int. Cl.
*G03G 21/00* (2006.01)

(52) U.S. Cl. ..... 399/129; 399/149; 399/150; 399/343; 399/353; 399/354

(58) Field of Classification Search ..... 399/127, 399/129, 149, 150, 343, 353, 354
See application file for complete search history.

(56) References Cited

U.S. PATENT DOCUMENTS 5,701,559 A * 12/1997 Ootaka et al. ..... 399/149
6,163,670 A 12/2000 Gomi et al. ..... 399/175
6,219,505 B1 * 4/2001 Sato et al. ..... 399/98
6,952,546 B2 10/2005 Yoshikawa ..... 399/129
2008/0107448 A1 * 5/2008 Takahashi et al. ..... 399/149

FOREIGN PATENT DOCUMENTS

| | | |
|---|---|---|
| JP | 5-053489 | 3/1993 |
| JP | 11-052678 | 2/1999 |
| JP | 2004-117960 | 4/2004 |
| JP | 2004-126102 | 4/2004 |

* cited by examiner

*Primary Examiner*—Hoan H Tran
(74) *Attorney, Agent, or Firm*—Fitzpatrick, Cella, Harper & Scinto

(57) ABSTRACT

An image forming apparatus includes a rotatable image bearing member; a charging member for electrically charging the image bearing member; developing device means for developing an electrostatic latent image formed on said image bearing member into a toner image and for collecting toner from the image bearing member; transfer device means for transferring the toner image onto a transfer material; a brush member rotatable in a direction identical or opposite to a rotational direction of the image bearing member and disposed downstream from the transfer device means and upstream from the charging member in the rotational direction of the image bearing member, the brush member contacting transfer residual toner while being supplied with a DC voltage of an opposite polarity to a normal charge polarity of the toner; and a moving member for moving the toner in a rotational axis direction of the brush member while contacting the brush member.

5 Claims, 4 Drawing Sheets

IMAGE FORMING APPARATUS

FIELD OF THE INVENTION AND RELATED ART

The present invention relates to an image forming apparatus, such as a printer, a copying machine, or a facsimile machine, of a cleaner-less type in which toner on an image bearing member is collected simultaneously with development.

In image forming apparatuses including a printer, a copying machine, a facsimile apparatus, etc., a cleaner-less type image forming apparatus with no dedicated cleaning apparatus has been known. In the image forming apparatus of this type, when a toner image formed on a photosensitive drum (image bearing member) is transferred onto a transfer material, toner (transfer residual toner) remaining on the photosensitive drum without being transferred onto the transfer material is collected by simultaneous developing and cleaning.

In the simultaneous developing and cleaning, during a developing step in a subsequent image forming cycle or later, the transfer residual toner remaining on the photosensitive drum after the transfer is again subjected to image formation, i.e., the photosensitive drum is electrically charged and exposed to light to form an electrostatic latent image while carrying thereon the transfer residual toner. The transfer residual toner is collected in a developing apparatus by a fog-removing bias (a potential difference (Vback) between a developing DC voltage and a drum potential in a non-image area) during development of the electrostatic latent image.

In a conventional cleaner-less type image forming apparatus (cleaner-less system or method), e.g., described in Japanese Laid-Open Patent Application (JP-A) 2004-117960, as shown in FIG. 6, in order to clear a history of a toner image after being subjected to a transfer step, a first auxiliary brush 8 to which a bias (voltage) of an opposite polarity to a normal (charge) polarity of toner is to be applied is provided. Further, a second auxiliary brush 7 for electrically charging transfer residual toner to the normal polarity by applying thereto a bias of an identical polarity to the normal polarity of the toner is provided downstream from the first auxiliary brush 8 in a rotational direction R1 of a photosensitive drum 1.

In the conventional image forming apparatus, a surface of the photosensitive drum 1 is electrically charged by a charging roller 2 and subjected to exposure to light L by an exposure apparatus 3 to form an electrostatic latent image. The electrostatic latent image is developed with toner by a developing apparatus 4 to form a toner image. The toner image is transferred onto a transfer material P by a transfer roller 5 and thereafter is fixed by a fixing apparatus 6.

The first auxiliary brush 8 erases or removes a transfer residual potential and transfer residual toner by applying thereto a DC voltage, of an opposite polarity to a toner charge polarity, biased with an AC voltage.

Further, the second auxiliary brush 7 electrically charges transfer residual toner passing through the first auxiliary brush 8 to the same polarity as that of the charging roller 2, thus preventing the transfer residual toner from depositing on the charging roller 2. The second auxiliary brush 7 is capable of collecting the transfer residual toner in an area corresponding to a non-image forming area (white background portion) during the development.

According to the cleaner-less method described above, the dedicated cleaning apparatus is not required, so that a size of the entire image forming apparatus can be reduced and an amount of waste developer is also decreased. Further, by using the cleaner-less method in combination with a process cartridge method, service maintenance is not required, so that maintenance can be performed by a user alone. As a result, maintainability can be considerably improved.

As described above, the cleaner-less type image forming method includes such a step that after a transfer step, a potential remaining on the photosensitive drum as an image history is removed in order to clear the image history and developer is subjected to dispersion of the image history and electrical re-charging to a charge polarity of the photosensitive drum.

However, the cleaner-less method of JP-A 2004-117960, transfer residual potential and transfer residual toner cannot be sufficiently cleared or removed in such a case that an image is outputted at high speeds. For this reason, thereafter, image stability is poor. Particularly, when an image having a high image ratio such as a full-color photographic image is continuously outputted, an amount of transfer residual toner is also increased. As a result, an amount of transfer residual toner depositing on the auxiliary brush 8 is increased.

When the amount of transfer residual toner is increased, a slippage of toner through the auxiliary brushes is frequently caused to occur, so that the transfer residual toner is deposited on a charging member in a large amount. In the case where the charging member is contact charging member such as the charging roller, charging failure is caused. To the toner deposited on the charging roller, it is impossible to apply such a constitution that toner is dispersed in a magnetic brush charger using magnetic particles as described, e.g., in JP-A Hei 11-52678, so that an amount of toner deposited on the charging roller is largely localized. This problem is similarly caused with respect to chargers, such as a blade charging member and the like, other than the charging roller.

In order to prevent the deposition of toner on the charging member, JP-A 2004-126102 has proposed such a method that clogging of an auxiliary charging brush is eliminated periodically or at a timing of post-rotation after completion of image formation.

However, even when such an elimination of clogging is effected, a contact surface between a brush portion and a photosensitive member is not changed in such a constitution that an auxiliary brush is fixed, so that the auxiliary brush is liable to be contaminated and increased in electric resistance. As a result, a function of the auxiliary brush is liable to be lowered. In view of this problem, by employing such a constitution that the auxiliary brush is rotated, it is possible to prevent the contamination at one position and maintain the function of the auxiliary brush for a long period of term.

However, even in such a constitution, there is the following problem. When such an image that an image density is largely localized in a width direction of a recording material (transfer material), e.g., a vertical stripe image (having stripes extending along a conveyance direction of the transfer material), is continuously outputted, transfer residual toner is concentrated at a particular portion. As a result, a problem of an occurrence of local clogging of the auxiliary brush is caused. For this reason, an image history clearing effect at the particular portion is lowered, so that the charging member is partially contaminated with transfer residual toner. As a result, electrical re-charging of the transfer residual toner and electrical charging of a photosensitive drum cannot be effected sufficiently, thus leading to a fluctuation in image density and occurrence of background fog due to a ghost image and charging failure.

JP-A Hei 05-053489 has described a constitution in which a flickering member is caused to enter the inside of a fur brush and reciprocated to scrape toner located inside the fur brush.

However, the flickering member actively scrapes or removes the toner, so that there arises such a problem that the toner scraped from the fur brush (auxiliary brush) partially contaminates a charging member when an image having a localized toner concentration ratio is continuously formed.

Further, a constitution in which an auxiliary brush is reciprocated in a rotational axis direction of a photosensitive member may also be used. However, in an image forming apparatus in which an amount of reciprocation is limited, it is impossible to eliminate localization of toner depending on an image. When the amount of reciprocation is increased in order to solve this problem, the image forming apparatus is increased in size.

In order to obviate the above described problems, it is necessary to prevent the localization of toner in the auxiliary brush irrespective of an image to be formed.

SUMMARY OF THE INVENTION

A principal object of the present invention is to prevent accumulation or deposition of toner on a brush member by decreasing a fluctuation in toner distribution of an auxiliary brush without increasing an amount of reciprocation of the auxiliary brush.

According to an aspect of the present invention, there is provided an image forming apparatus comprising:

a rotatable image bearing member;

a charging member for electrically charging the image bearing member;

developing means for developing an electrostatic latent image formed on said image bearing member into a toner image and for collecting toner from the image bearing member;

transfer means for transferring the toner image onto a transfer material;

a brush member rotatable in a direction identical or opposite to a rotational direction of the image bearing member and disposed downstream from the transfer means and upstream from the charging member in the rotational direction of the image bearing member, the brush member contacting transfer residual toner while being supplied with a DC voltage of an opposite polarity to a normal charge polarity of the toner; and a moving member for moving the toner in a rotational axis direction of the brush member while contacting the brush member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
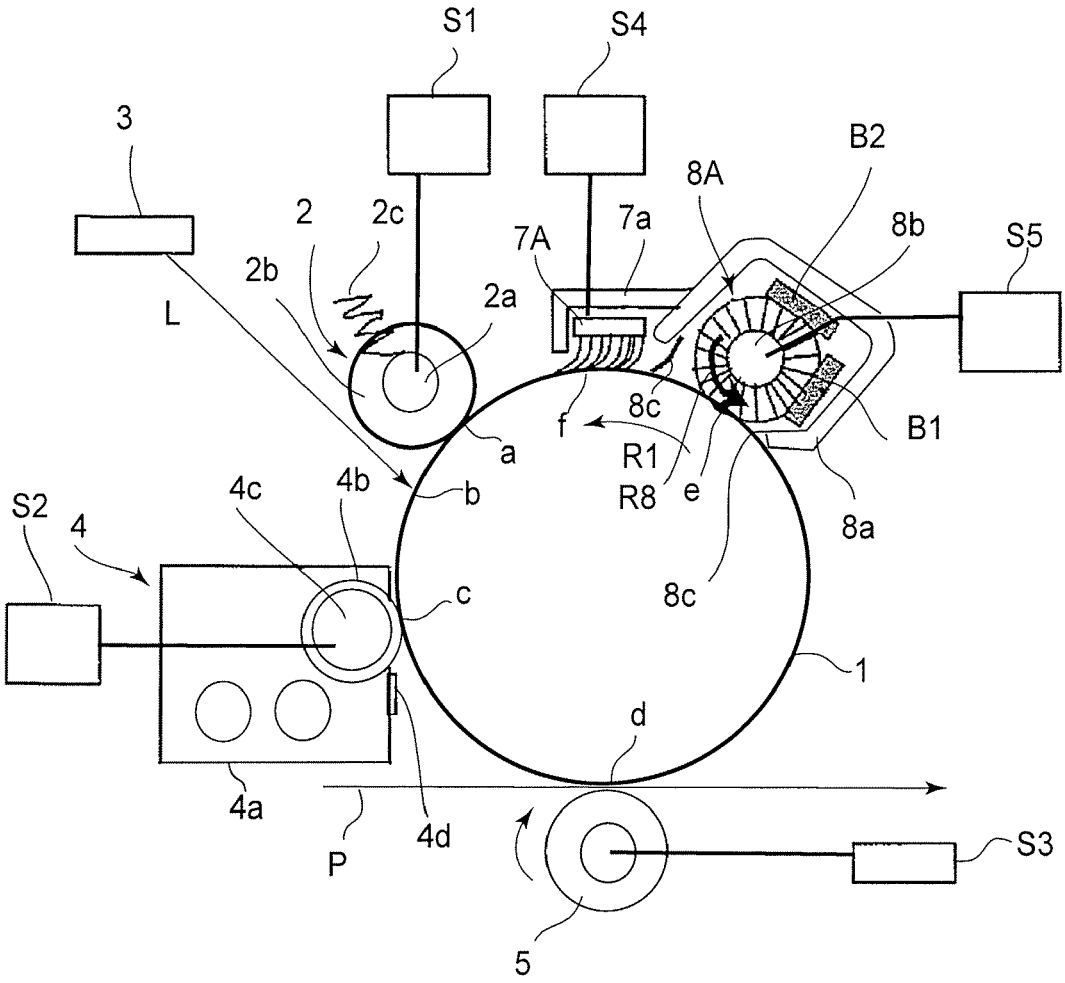
FIG. 1 is a schematic view for illustrating a constitution of an image forming apparatus.

Hereinbelow, embodiments of the present invention will be described with reference to the drawings. Incidentally, members or means represented by the same reference numerals or symbols in the figures have the same constitution or functions, thus being appropriately omitted from redundant explanation.

Embodiment 1

FIG. 1 shows an image forming apparatus to which the present invention is applicable. The image forming apparatus shown in FIG. 1 is a laser beam printer of an electrophotographic type, contact charging type, and reversal development type. A maximum size of sheet capable of being passed through the printer is A3-size. FIG. 1 is a schematic view corresponding to a longitudinal sectional view as viewed from a front side of the printer, i.e., a side on which a user is located during an operation of the printer.

A constitution and the operation of the printer as the image forming apparatus according to the present invention will be described with reference to FIG. 1.

(1) Generation Constitution of Entire Image Forming Apparatus (a) Image Bearing Member (Photosensitive Drum)

The image forming apparatus shown in FIG. 1 includes a rotation drum-type electrophotographic photosensitive member as an image bearing member (hereinafter referred to as a "photosensitive drum") 1. The photosensitive drum 1 includes a negatively chargeable OPC (organic photoconductor) as a photosensitive layer. The photosensitive drum 1 has an outer diameter of 30 mm and is rotationally driven in a direction of an indicated arrow R1 (counterclockwise direction) at a process speed (peripheral speed) of 150-250 mm/sec with a center axis as a center.

Figure 2:
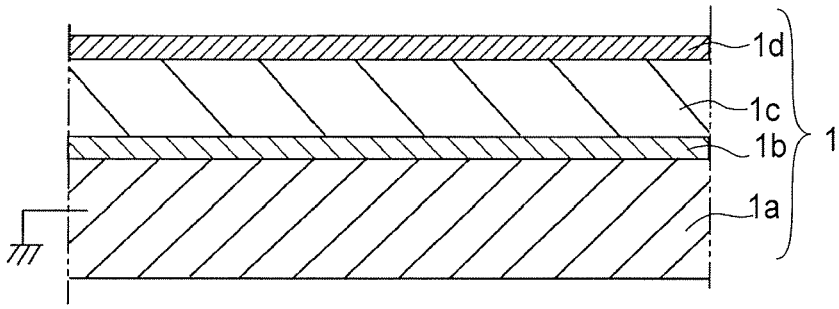
FIG. 2 is a schematic view for illustrating a layer structure of a photosensitive drum.

FIG. 2 shows a schematic layer structure of the photosensitive drum 1. In FIG. 2, an upper side and a lower side of the photosensitive drum 1 correspond to the outside and the inside thereof, respectively. The photosensitive drum 1 has such a constitution that on a surface of an electroconductive drum support 1*a* of aluminum or the like, three layers including an undercoat layer 1*b* for suppressing light interference and improving adhesiveness to an overlying layer, a photocharge generation layer 1*c*, and a charge transport layer 1*d* are successively coated in this order. The drum support 1*a* is grounded.

(b) Charging Member (Charging Roller)

At a periphery of the photosensitive drum 1, a charging roller (contact charger) 2 as a charging member is disposed to contact the surface of the photosensitive drum 1 and electrically charges the (outer peripheral) surface of the photosensitive drum 1 uniformly.

The charging roller 2 is constituted by providing an elastic layer 2*b* to an outer peripheral surface of a core metal 2*a* and held rotatably by bearing members (not shown) at both longitudinal end portions of the core metal 2*a*. The bearing members are biased toward the surface of the photosensitive drum 1 by pressing springs 2*c*, whereby the charging roller 2 is pressed against the surface of the photosensitive drum 1 at a predetermined pressing force and rotated in a clockwise direction by the rotation of the photosensitive drum 1 in the rotational direction indicated by the arrow R1. A pressure contact portion between the photosensitive drum 1 and the charging roller 2 constitutes a charging (nip) portion a.

To the core metal 2*a* of the charging roller 2, a charging bias voltage is applied from a charging bias application power source S1 under a predetermined condition. For example, the predetermined condition includes the case of applying only a DC voltage or the case of applying a DC voltage biased or superposed with an AC voltage. The photosensitive drum 1 during the rotation is, in this embodiment, subjected to contact charging so that the (outer peripheral) surface thereof is negatively charged.

(c) Information Writing Means (Exposure Apparatus)

On the surface of the photosensitive drum 1 after the charging, an electrostatic latent image is formed by an exposure apparatus 3 as an electrostatic latent image forming means. In this embodiment, the exposure apparatus 3 is a laser beam scanner. The laser beam scanner outputs laser light modulated corresponding to an image signal sent from a host apparatus (not shown) such as an image reading apparatus or the like to the image forming apparatus so that the uniformly charged surface of the photosensitive drum 1 is subjected to laser scanning exposure (image scanning exposure) to light L. By the laser scanning exposure to light L, a potential at a laser light-irradiated portion of the surface of the photosensitive drum 1 is lowered. As a result, an electrostatic latent image corresponding to image information, subjected to scanning exposure is successively formed on the photosensitive drum 1 surface.

(d) Developing Means (Developing Apparatus)

Along the rotational direction of the photosensitive drum 1, a developing apparatus 4 as a developing means is disposed downstream from the exposure apparatus 3. The developing apparatus 4 includes a developer container 4*a* containing developer (toner), a nonmagnetic developing sleeve 4*b*, a magnet roller 4*c*, and a regulation blade 4*d*. In this embodiment, a normal charge polarity of the toner is negative.

The developing sleeve 4*b* is rotatably disposed in the developing container 4*a* while being partially exposed to the outside thereof at an outer peripheral surface. The magnet roller 4*c* is inserted into the developing sleeve 4*b* in a fixed (nonrotational) state. The regulation blade 4*d* regulates a layer thickness of the developer on the developing sleeve 4*b*. In the developing container 4*a*, a monocomponent magnetic toner having a negative chargeability as the developer is accommodated. To the developing sleeve 4*b*, a developing bias application power source S2 is connected.

In the developing apparatus 4 having the above described constitution, the monocomponent magnetic toner is coated on the surface of the developing sleeve 4*b* as a thin layer by the regulation blade 4*d*. This toner is conveyed to a developing portion c by the rotation of the developing sleeve 4*b*. At the developing portion c, the toner is selectively deposited corresponding to the electrostatic latent image at the surface of the photosensitive drum 1 by applying a developing bias, comprising a negative DC bias superposed with an AC bias, from the developing bias application power source S2 to the developing sleeve. As a result, the electrostatic latent image on the photosensitive drum 1 is developed as a toner image. In this embodiment, through jumping development, the toner is deposited on the photosensitive drum 1 surface at a light portion subjected to light exposure, whereby the electrostatic latent image is reversely developed.

The toner which has not been deposited on the photosensitive drum 1 surface and has passed through the developing portion c is returned to a developer reservoir in the developer container 4*a* by a subsequent rotation of the developing sleeve 4*b*.

(d) Transfer Means (Transfer Roller)

As a transfer means, a transfer roller 5 disposed in contact with the photosensitive drum 1 surface is used. Between the photosensitive drum 1 and the transfer roller 5, a transfer potion d is created. A transfer material P which has been conveyed to the transfer portion d by a conveying (feeding) means (not shown) is nipped and conveyed between the photosensitive drum 1 and the transfer roller 5. At this time, to the transfer roller 5, a transfer bias of a positive polarity opposite to the normal (negative) charge polarity of the toner on the photosensitive drum 1 is applied from a transfer bias application power source S3. As a result, the toner image on the photosensitive drum 1 is electrostatically transferred onto the transfer material P successively.

(f) Fixing Means (Fixing Apparatus)

The transfer material P after the toner image transfer is separated from the photosensitive drum 1 surface and conveyed into a fixing apparatus (not shown). In the fixing apparatus, the transfer material P is nipped and conveyed between a heated fixing roller (not shown) and a pressing roller (not shown) pressed against the fixing roller via the transfer material P, whereby the transfer material P is heated and pressed to fix the toner image at the surface thereof. The transfer material P after the toner image fixation is discharged (outputted) to the outside of a main assembly (not shown) of the image forming apparatus as an image formed product (print or copy).

In the present invention, along the photosensitive drum of the photosensitive drum 1, a first brush member 8 is disposed downstream from the transfer portion d and upstream from the charging portion a, and a second brush member 7 is disposed downstream from the first brush member 8 and upstream from the charging portion a.

(g) First Brush Member (First Auxiliary Charging Member)

The first brush member (rotation history cleaning means) 8 has a rotation brush 8A rotating in an arrow R8 direction in a state of contact with the surface of the photosensitive drum 1. The rotational direction of the rotation brush 8A is such a direction that a portion of the rotation brush 8A contacting the photosensitive drum 1 surface moves opposite to the rotational direction of the photosensitive drum 1. In this embodiment, however, there is no problem even when the rotational direction of the rotation brush 8A is identical to the rotational direction of the photosensitive drum 1.

The rotation brush 8A contacts the photosensitive drum 1 surface at a position above a center axial line (rotation center line) of the photosensitive drum 1. More specifically, a contact portion e between the photosensitive drum 1 surface and the rotation brush 8A is set at a position higher than the center axis of the photosensitive drum 1, so that the developer is less liable to scatter and drop when an image history is cleared or erased by the rotation of the rotation brush 8A and a part of the developer is scraped or removed. Further, the developer is less liable to be deposited in a housing 8*a* covering the rotation brush 8A.

When the rotation brush 8A has a peripheral speed of Ub (mm/sec) and the photosensitive drum 1 has a peripheral speed Ud (mm/sec), the rotation brush 8A is rotated to provide a speed ratio satisfying $Ub/Ud \leqq 1$ . The surface of the photosensitive drum 1 after the toner image is transferred onto the transfer material P is rubbed by the rotation brush 8A at the contact portion e, whereby the toner (transfer residual toner) remaining on the photosensitive drum 1 surface without being transferred onto the transfer material P during the toner image transfer is caught by the rotation brush 8A to be temporarily removed from the surface of the photosensitive drum 1.

Further, to a core metal 8*b* of the rotation brush 8A, a high DC voltage which has a polarity opposite to the charge polarity of the photosensitive drum 1 by the charging roller 2 and is biased with a high AC voltage is applied by a bias application power source (First power source) S5. In other words, the DC voltage is a DC bias of an opposite polarity to the normal charge polarity of the toner. By applying this DC bias (the combination of the high DC voltage and the high AC voltage), a history of latent potential remaining at the surface of the photosensitive drum 1 after passing through the transfer portion d is converged at a predetermined potential. In this embodiment, the high DC voltage applied from the bias application power source S5 to the rotation brush 8A is approximately 100-400 V. The high AC voltage superposed on the high DC voltage is a rectangular wave of a frequency of 100-2000 Hz equal to that of the charging roller 2 and a peak-to-peak voltage of approximately 200-500 V.

Further, the transfer residual toner on the photosensitive drum 1 is placed in a state of distribution of toner including a low-charged component unable to be transferred and a component reversely charged by peeling discharge at the transfer portion in mixture. For this reason, the transfer residual toner is in such a state that it is unable to actively move due to a difference in potential between the high DC voltage and a drum potential of the photosensitive drum 1 after passing through the transfer portion d, so that the transfer residual toner is scraped by a mechanical friction by the rotation brush 8A but a part thereof passes through the contact portion e as it is.

Figure 3:
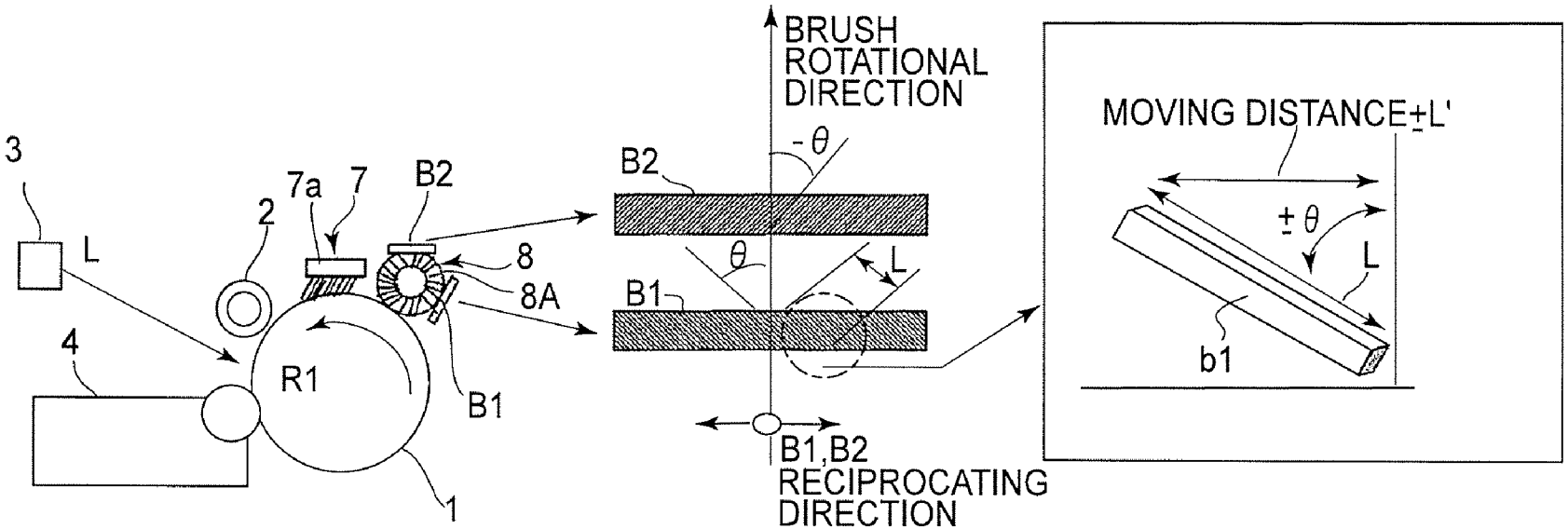
FIG. 3 is a schematic view for illustrating a constitution and arrangement of a toner dispersing member.
Figure 4:
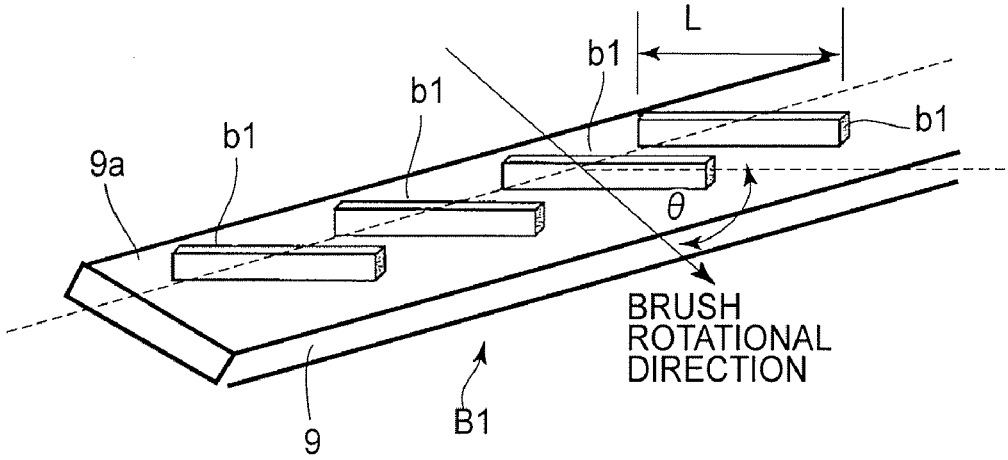
FIG. 4 is a schematic perspective view for illustrating guides projected at a contact surface of the toner dispersing member with a rotation brush.

At the contact portion e, the toner scraped from the photosensitive drum 1 surface then contacts toner dispersing members B1 and B2 as a moving member as shown in FIG. 3. The toner dispersing member B1 includes, as shown in FIG. 4, an elongated base plate 9 extending along a generatrix direction of the photosensitive drum 1 and a plurality of quadrangular prism-like guides (guiding portions) b1 projected or protruded from a contact surface 9*a* of the base plate 9 with the rotation brush 8A. The plurality of guides b1 is arranged with an appropriate pitch (spacing) in a longitudinal direction of the base plate 8 at a predetermined inclination angle θ with respect to the rotational direction (moving direction) of the rotation brush. The angle θ is set in a range of 45 degrees≦θ<90 degrees. In other words, an intersecting angle between the rotational direction of the brush member and the guides b1 is more than zero degrees and 45 degrees or less. Further, adjacent two guides b1 and b1 are disposed to partially overlap with each other in the generatrix direction of the photosensitive drum 1. More specifically, the toner scraped from the photosensitive drum 1 surface by the rotation brush 8A always strikes any of the guides b1. The toner dispersing member B1 has the above described constitution. The other toner dispersing member B2 has the same constitution as that of the toner dispersing member B1 except that the angle θ of guides b1 is set at −θ. The toner dispersing member B2 is disposed downstream from the contact portion e and the toner dispersing member B1 along a rotational direction of the rotation brush 8A. In this embodiment, the guides 1*b* of the toner dispersing member B1 and those of the toner dispersing member B2 have opposite angles θ and −θ and an identical absolute value thereof. However, in the present invention, absolute values of the angles of the guides 1*b* for the toner dispersing member B1 and B2 may also be not necessarily identical to each other so long as direction of the angles are opposite to each other.

The toner on the surface of the photosensitive drum 1 is caught, in a dispersion state on a rotational axis direction of the rotation brush 8A, at the contact portion e by mechanical friction wit the rotation brush 8A. The thus caught toner by the rotation brush 8A is conveyed along the toner dispersing members B1 and B2 as the toner moving member. As a result, as shown in FIG. 3, the toner is moved in the generatrix direction at the photosensitive drum 1 surface by a moving distance ±L' (=L×sin±θ) determined by the angles ±θ of the guides b1 of the toner dispersing members B1 and B2 and a length L of each guide b1.

Most of the toner scraped from the photosensitive drum 1 surface by the rotation brush 8A contacts the toner dispersing members B1 and B2 and is dispersed in the directions of the angles ±θ, i.e., the rotational direction and generatrix direction of the photosensitive drum 1 to clear an image history. The dispersed toner is then deposited on the rotation brush 8A and again contacts the photosensitive drum 1 to be moved again to the surface of the photosensitive drum 1.

In this embodiment, as a material for the toner dispersing members B1 and B2, an insulating resin material is employed. This is because only the image history is intended to be cleared without adversely affecting the charge polarity of the toner scraped off the photosensitive drum 1.

The above described housing 8*a* is, as shown in FIG. 1, formed in an inclined U-character like cross-sectional shape so as to cover the rotation brush 8A and the toner dispersing members B1 and B2 from three directions. Further, to upstream and downstream end portions of the housing 8*a*, toner scattering prevention sheets 8*c* are attached in order to close a gap thereof with the photosensitive drum 1 surface. As a result, the toner scraped by the rotation brush 8A is prevented from leaking out of the housing 8*a*.

(h) Second Brush Member (Second Auxiliary Charging Member)

In the above described manner, the toner returned again from the rotation brush 8A to the photosensitive drum 1 surface is conveyed to a second brush member 7 by the rotation of the photosensitive drum 1 in the direction of the arrow R1. The second brush member 7 includes a nonrotational brush 7A disposed downstream from the rotation brush along the rotational direction of the photosensitive drum 1 while extending along the generatrix direction of the photosensitive drum 1. The nonrotational brush 7 is covered, on back and downstream sides thereof, with a housing 7*a* integrally formed with the housing 8*a* described above. The nonrotational brush 7A is reciprocated along a generatrix by a reciprocating mechanism (not shown). The toner deposited again from the rotation brush 8A to the photosensitive drum 1 surface is further uniformized in the generatrix direction by the reciprocating motion.

To the nonrotational brush 7A, a high DC voltage of the same polarity as that of the charging roller 2 is applied from a bias application power source (second power source) S4 under such a condition that a value thereof is a potential generated by DC discharge. By the discharge, the transfer residual toner is negatively charged to be less liable to deposit electrically on the charging member each when it passes through the charging member. In this embodiment, the value of the high DC voltage applied to the nonrotational brush 7A is set in a range of 700-900 V.

Figure 5:
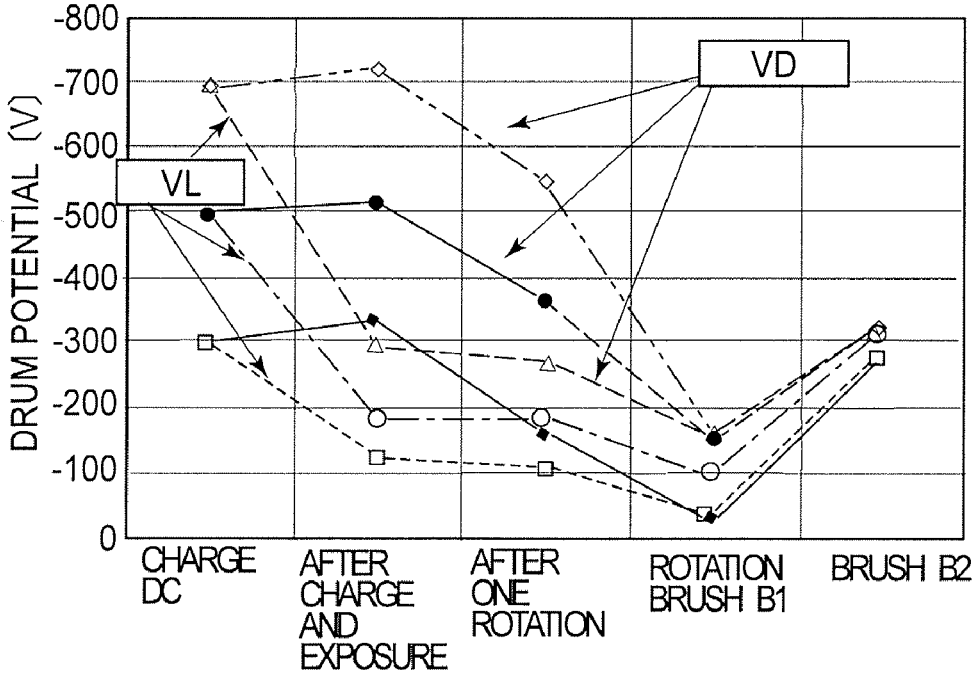
FIG. 5 is a graph for illustrating potentials at a periphery of a photosensitive drum during image formation.
Figure 6:
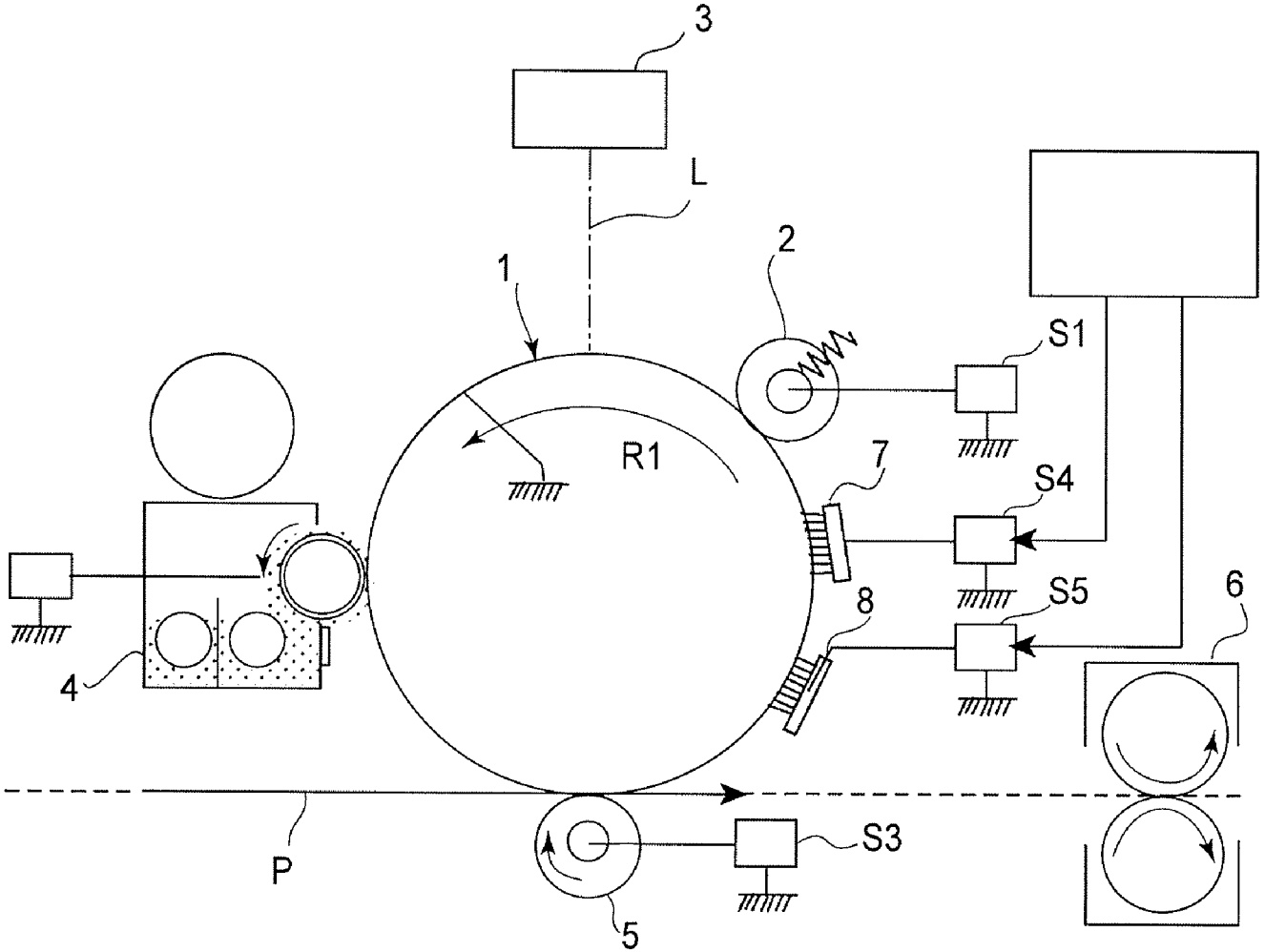
FIG. 6 is a schematic view for illustrating a constitution of a conventional cleaner-less type image forming apparatus.

The charge potential created by the DC discharge is set, as shown in FIG. 5, to be lower than DC voltages applied to the charging roller 2. This is because an irregularity in charge potential is caused to occur when a drum potential exceeding the DC potential of the charging roller 2 is given by the nonrotational brush 7A, so that prevention of the charge potential irregularity is required. In FIG. 5, potentials indicated by "VL" represent light-part potentials and those indicated by "VD" represent dark-part potentials. In this embodiment, the brush 7A is the nonrotational brush but there is no problem even when it is a rotation brush.

The toner on the photosensitive drum 1 is electrically charged to the same polarity as that of the high DC voltage of the charging roller 2 by the DC discharge between the nonrotational brush 7A and the photosensitive drum 1. In this case, the toner is placed in such a charging state that an amount of charge thereof is equivalent level to that of the developer in the developing apparatus 4. As a result, it is possible to achieve a so-called simultaneous developing and cleaning performed by a non-image portion potential difference between the potential created by the charging roller 2 and the high DC voltage of the developing apparatus 4.

By using at least the first brush member as described above, even when an image having a localized ratio of toner concentration in a main scanning direction is outputted many times, it is possible to decrease a localization of distribution of the transfer residual toner in a longitudinal direction of the brush member.

Embodiment 2

In Embodiment 1 described above, the toner dispersing members B1 and B2 for the first brush member 8 are not moved in the generatrix direction of the photosensitive drum 1. In this embodiment, these toner dispersing members B1 and B are constituted so that they are capable of being reciprocated in the generatrix direction of the photosensitive drum 1 by a reciprocating mechanism (not shown), thus further enhancing toner dispersion ability in the rotational axis direction of the brush member.

As the reciprocating mechanism, that for moving the above described nonrotational brush 7A can also be used for moving the toner dispersing members B1 and B2, thus resulting in a simple constitution compared with the case of using different reciprocating mechanisms.

As in this embodiment, by reciprocating the toner dispersing members B1 and B2 in the rotational axis direction of the brush member, the toner dispersion ability in the rotational axis direction can be further improved. Further, uniformization of charge injection to the toner and stabilization of precharging potential supplied to the charging roller 2 are realized while further uniformizing the distribution of the toner re-deposited on the photosensitive drum 1 by means of the nonrotational brush 7A.

By employing the constitutions of the above described embodiments, even when an image such as a photographic image having a large image ratio is continuously outputted by a high-speed machine in a system employing the simultaneous developing and cleaning, it is possible to achieve stable image formation without causing a ghost image due to the image history of the transfer residual toner and a local contamination to the charging roller 2.

As described above, according to the present invention, it is possible to decrease the local distribution of the transfer residual toner in the longitudinal direction of the auxiliary charging means even when the image having a localized ratio of toner concentration in the main scanning direction is outputted many times.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 347218/2005 filed Nov. 30, 2005, which is hereby incorporated by reference.

What is claimed is:

1. An image forming apparatus comprising:

a rotatable image bearing member;

a charging member for electrically charging said image bearing member;

developing means for developing an electrostatic latent image formed on said image bearing member into a toner image and for collecting toner from said image bearing member;

transfer means for transferring the toner image onto a transfer material;

a brush member rotatable in a direction identical or opposite to a rotational direction of said image bearing member and disposed downstream from said transfer means and upstream from said charging member in the rotational direction of said image bearing member, said brush member contacting transfer residual toner while being supplied with a DC voltage of an opposite polarity to a normal charge polarity of the toner; and a moving member for moving the toner in a rotational axis direction of said brush member while contacting said brush member.

2. An apparatus according to claim 1, wherein said moving member has an inclination at a predetermined angle in the rotational axis direction of said brush member and moves the toner, deposited on said brush member, in the rotational axis direction of said brush member.

3. An apparatus according to claim 1, wherein said moving member has a plurality of guide portions inclined in an identical direction.

4. An apparatus according to claim 3, wherein said guide portions intersect with the rotational axis direction at an angle of larger than zero degrees and smaller than 45 degrees.

5. An apparatus according to claim 3, wherein said guide portions are reciprocatable in the rotational axis direction of said brush member.

* * * * *